United States Patent [19]

Nakai et al.

[11] Patent Number: 4,480,651

[45] Date of Patent: Nov. 6, 1984

[54] COIN FEEDING APPARATUS FOR A COIN DISPOSING MACHINE

[75] Inventors: Shiro Nakai; Takao Baba, both of Himeji, Japan

[73] Assignee: Glory Kogyo Kabushiki Kaisha, Japan

[21] Appl. No.: 396,216

[22] Filed: Jul. 8, 1982

[30] Foreign Application Priority Data

Jul. 16, 1981 [JP] Japan ..... 56-111456
Dec. 24, 1981 [JP] Japan ..... 56-196850

[51] Int. Cl.[3] ..... G07D 3/00
[52] U.S. Cl. ..... 133/3 A; 221/10
[58] Field of Search ..... 133/3 A, 3 F, 3 H, 8 E; 194/DIG. 14; 198/443, 392; 221/10

[56] References Cited

U.S. PATENT DOCUMENTS 4,172,462 10/1979 Uchida et al. ..... 133/3 A
4,279,336 7/1981 Henderson et al. ..... 133/3 A

FOREIGN PATENT DOCUMENTS 1137884 10/1962 Fed. Rep. of Germany ..... 133/3 A

*Primary Examiner*—Stanley H. Tollberg

*Attorney, Agent, or Firm*—Beveridge, DeGrandi & Kline

[57] ABSTRACT

In a coin disposing apparatus, a mechanism is disclosed for aligning a random supply of coins preparatory to further processing. Included is a rotary disc for receiving thereon the coins to be processed from an overhead belt conveyor and for centrifugally sending the coins toward the disc periphery. A coin runway extends from a peripheral position on the rotary disc to a subsequent processing station for aligned delivery of the coins. An endless belt makes frictional contact with the periphery of the rotary disc, except at least where the entrance of the coin runway is located, for simultaneous rotation therewith. Thus, on being centrifugally forced into peripheral contact with the endless belt on the rotary disc, the coins do not revolve about their own axes, unlike the case where the disc rotates inside a fixed annular wall, and so is smoothly and noiselessly fed into the runway one by one. The invention also features a fixed annular wall arranged over the endless belt rotary wall. When coins piled up on the rotary disc contact the fixed wall, a conduction sensor electrically senses an oversupply of coins and sets the overhead conveyor out of operation.

5 Claims, 3 Drawing Figures

COIN FEEDING APPARATUS FOR A COIN DISPOSING MACHINE

BACKGROUND OF THE INVENTION

This invention relates generally to a coin disposing apparatus for counting, sorting and/or otherwise processing coins, and particularly to a mechanism in such a coin disposing apparatus for aligning a random supply of coins preparatory to delivery to a subsequent processing station.

A coin disposing apparatus of the type in question receives coins to be processed in a totally random manner. The proper alignment of such a random supply of coins is essential for the desired processing of the coins. As heretofore constructed, the coin aligning mechanism in such processing apparatus comprises a rotary disc surrounded by a stationary annular wall, and a linear coin runway extending approximately radially outwardly of the disc from a peripheral position thereon. The rotary disc receives coins from an overhead supply conveyor. Revolving at sufficiently high speed, the disc centrifugally throws the coins into abutting contact with the relatively fixed annular wall. The coin runway accepts the coins one by one from the periphery of the rotary disc and delivers them in a row to a counting or other processing station.

One of the problems with the above outlined type of known coin aligning mechanisms arises by reason of the fixed annular wall around the rotary disc. Upon abutting engagement of the coins on the rotary disc with the fixed wall, friction occurs which tends to arrest the travel of the coins with the disc. That results in the revolution of the coins about their own axes, in a direction opposite to the rotative direction of the disc.

Such frictional rotation of the coins about their own axes becomes more and more pronounced in case of an increase in the rotative speed of the disc. The higher the speed of the disc, the greater is the centrifugal force exerted on the coins to send them into abutment against the fixed wall. Thus the friction between the coins and the wall increases until at last the coins start slipping over the rotary disc and so no longer travel with the disc toward the entrance of the coin runway. This is a crucial drawback of the conventional coin aligning mechanism, running counter to the present-day demand for higher speed processing of coins.

Another problem with coin aligning mechanisms of the prior art concerns a system for the controlled supply of coins onto the rotary disc. In a large capacity disposing apparatus, wherein coins are loaded on the noted overhead supply conveyor from a hopper for bulk delivery onto the rotary disc, means are commonly employed for controlling the coin delivery from the conveyor to the disc. An oversupply of coins onto the rotary disc may result in their jamming at the entrance of the coin runway. To avoid this large capacity coin disposing apparatuses have provisions for sensing a coin oversupply on the rotary disc and for setting the supply conveyor out of operation upon occurrence of such an oversupply. The control means automatically cause the supply conveyor to resume coin delivery onto the rotary disc upon decrease of the amount of coins thereon to a proper degree.

Typical means conventionally adopted for sensing coin oversupply is a Microswitch, the trade name for a small electrical switch wherein contact is made or broken by a slight motion. The Microswitch has an actuator arm overhanging the rotary disc from the fixed annular wall. Upon upward displacement of the actuator arm by the coins piled up on the rotary disc, the Microswitch sets the supply conveyor out of operation, during the descent of the actuator arm to its normal angular position.

An objection to the above known oversupply sensing means is that the Microswitch with the mechanically displaced actuator arm does not necessarily correctly ascertain coin oversupply and easily malfunctions. Another objection arises from the fact that the Microswitch lies in a fixed position on the annular wall around the rotary disc. A pile of coins on the disc does not activate the Microswitch actuator arm until the pile comes around to the location of the arm. Furthermore, should the oversupply sensing means allow the delivery of an excessive quantity of coins onto the rotary disc for either of the above reasons, the coins may become caught between the disc and the overhanging actuator arm, making the sensing means totally incapable of functioning.

SUMMARY OF THE INVENTION

The present invention solves the above stated problems and objections encountered with the known coin aligning mechanisms in a coin disposing apparatus of the type under consideration. More specifically, the invention meets today's demand for high speed processing of coins by making it possible to revolve the rotary disc of the coin aligning mechanism at high speed, for high speed alignment of coins, without giving rise to the rotation of the coins about their own axes on the rotary disc and to the consequent coin slippage thereon. The invention also provides improved means for accurately and quickly sensing an oversupply of coins on the rotary disc for controlling the delivery of coins thereto accordingly.

Summarized in its broader aspect, the invention provides a coin aligning mechanism comprising a rotary disc and a coin runway, with the latter extending away from the former for delivery of coins in a row to a subsequent processing station. The invention particularly features a rotary wall, in place of the conventional stationary wall, extending along the periphery of the rotary disc, except at least where the entrance of the coin runway is located, for simultaneous rotation therewith and serving to confine the coins on the rotary disc.

In a preferred embodiment the rotary wall takes the form of an endless belt wrapped around the specified part of the periphery of the rotary disc. Being in frictional contact with the rotary disc, the belt runs at the same speed as the peripheral speed of the disc. Thus, upon being centrifugally sent into abutting engagement with the endless belt around the rotary disc, the coins neither revolve about their own axes nor slip over the disc by virtue of a lack of relative motion between the disc and the wall. The coins can therefore be fed at high speed into the coin runway. The improved coin aligning machanism offers an additional advantage of noiseless operation. In the known coin aligning mechanism with the nonrotatable wall around the rotary disc, hissing and jingling sounds have been generated as the coins slip over the disc and strike against one another as a result of revolution about their own axes in frictional engagement with the nonrotatable wall. The improved mechanism of this invention remarkably reduces such noise.

Another important feature of the invention resides in improved oversupply sensing means structurally and functionally associated with the rotary wall around the rotary disc. The oversupply sensing means include a fixed or nonrotatable annular wall overlying the rotary wall in register therewith. The coins on the rotary disc touch the fixed wall only when piled up in a heap of at least a preselected number as a result of an oversupply. Also included are means for causing coin supply means, such as an overhead belt conveyor, to suspend the supply of coins onto the rotary disc upon sensing the contact of the fixed wall with the piled coins on the disc.

Both the rotary disc and the fixed wall are of electroconductive material, normally electrically disconnected from each other, in the preferred embodiment. Electrical connection between the two members takes place upon contact of the fixed wall with the piled coins on the rotary disc. This oversupply sensing system, functioning purely electrically, thoroughly overcomes the objections raised in connection with the prior art system using a Microswitch with the mechanically operated actuator arm.

The above and other features and advantages of this invention and the manner of attaining them will become more apparent, and the invention itself will best be understood, from a study of the following description and appended claims, with reference to the attached drawings showing the preferred embodiment of the invention.

DESCRIPTION OF THE PREFERRED EMBODIMENT

Figure 1:
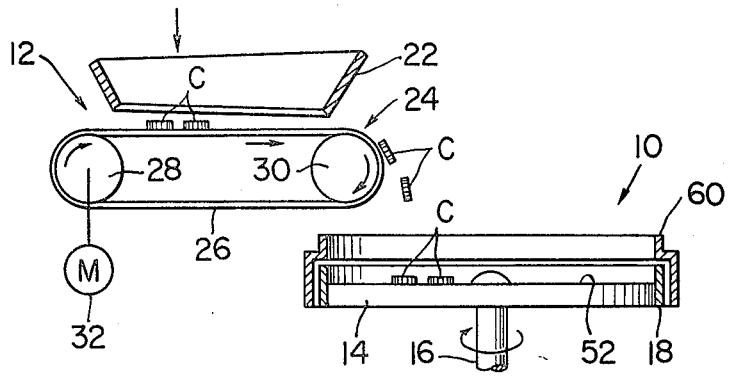
FIG. 1 is a diagrammatic representation, partly in vertical section and partly in elevation, of part of the coin aligning mechanism constructed in accordance with the invention, shown together with a coin supply mechanism for the bulk delivery to the aligning mechanism of coins to be processed.

The reference numeral 10 in FIG. 1 generally denotes the coin aligning mechanism embodying the invention, therein shown together with a coin supply mechanism 12 in preassigned positional relation. Insofar as it is pictured in FIG. 1, the coin aligning mechanism 10 includes a rotary disc 14 mounted on an upstanding spindle 16 for joint rotation therewith about its vertical axis. Encircling the rotary disc 14 are a rotary wall 18 and, thereover, a stationary wall 60. A more detailed explanation of the coin aligning mechanism 10 will be later given in connection with FIGS. 2 and 3.

The coin supply mechanism 12 is shown to comprise a loading hopper 22 and a belt conveyor 24, the latter being hereinafter referred to as the supply conveyor. Immediately underlying the loading hopper 22, the supply conveyor 24 comprises an endless belt 26 operating over a drive pulley 28 and an idler pulley 30. While FIG. 1 shows a very diagrammatic driving arrangement, nonetheless it will be discerned that the drive pulley 28 is coupled to an electric motor 32 for driving the conveyor belt 26 in the arrow marked direction. Coins C to be processed are deposited from the loading hopper 22 on the upper flight of the conveyor belt 26 thereby to be transported to the right, as viewed in FIG. 1, until they fall off the right hand extremity of the conveyor onto the rotary disc 14 of the coin aligning mechanism 10. Thus receiving the random supply of coins C from the overhead supply conveyor 24, the coin aligning mechanism 10 rearranges them into a neat row as set forth subsequently.

It is to be noted that the coin supply mechanism 12 may not necessarily be of the illustrated construction. For instance, instead of the belt conveyor, there may be adopted a rotary disc or any other means capable of more or less similarly supplying coins to the coin aligning mechanism 10. Such alternative means, however, must admit of on/off control for the controlled delivery of coins to the aligning mechanism.

Figure 2:
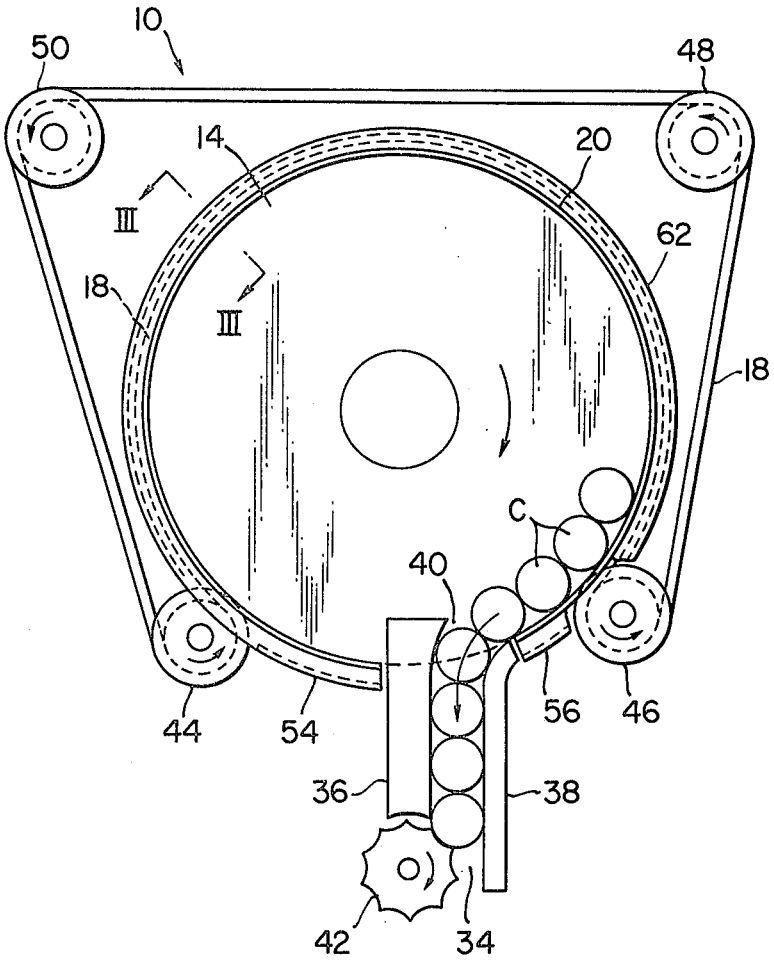
FIG. 2 is an enlarged top plan view of the coin aligning mechanism of FIG. 1.

FIG. 2 is an enlarged, more detailed representation of the coin aligning mechanism 10. In addition to the rotary disc 14 and its surrounding walls 18 and 20 the aligning mechanism includes a linear coin runway 34 extending approximately radially outwardly from the rotary disc in coplanar relationship thereto. Defined on both sides by a pair of guides 36 and 38, the coin runway 34 has an entrance 40 lying in a peripheral position on the rotary disc 14 for admitting the coins C therefrom. The coin runway is equipped with known coin discriminating means, permitting the passage of a prescribed denomination only. At the distal end of the coin runway is a counting station having a counter wheel 42 for counting the coins by being revolved through a preset angle by each coin travelling therepast. The counting mechanism can also be conventional, so that no more explanation will be necessary on the subject.

Next to be referred to, with reference directed also to FIG. 2, is the rotary wall 18 around the rotary disc 14 constituting one of the features of the invention. The term "rotary wall" used hereinabove is generic; specifically, it takes the form of an endless belt in the illustrated embodiment. The rotary wall 18 will hereinafter be referred to as the endless belt or simply as the belt.

The endless belt 18 extends around four guide pulleys 44, 46, 48 and 50. Of these the pulleys 44 and 46 lie on opposite sides of the coin runway 34 and close to the circumference of the rotary disc 14, whereas the other two pulleys 48 and 50 are disposed opposite to the pulleys 44 and 46 across the rotary disc. As it extends between the pulleys 44 and 46, the belt 18 encloses the periphery of the rotary disc 14 except the entrance 40 of the coin runway 34 and the neighboring parts of the disc periphery on its opposite sides. Those flights of the belt which run between the pulleys 46 and 48, the pulleys 48 and 50, and the pulleys 50 and 44 are out of contact with the rotary disc 14. At least one of the pulleys is movable in opposite directions for adjustment of belt tension. This belt tension is so adjusted that the belt span between the pulleys 44 and 46 is pressed against the periphery of the rotary disc. Thus, with the rotation of the rotary disc, the endless belt travels at a speed equal to the peripheral speed of the disc.

Figure 3:
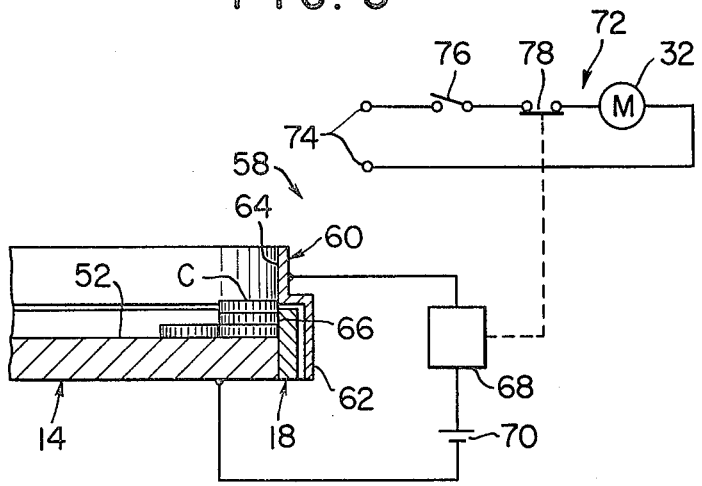
FIG. 3 is a fragmentary section through the coin aligning mechanism taken along the line III—III of FIG. 2, shown together with a schematic electrical diagram of a circuit for controlling the delivery of coins from the supply mechanism to the aligning mechanism.

As will be seen from both FIGS. 1 and 3, the endless belt 18 has a width greater than the thickness of the rotary disc 14, projecting upwardly beyond the coin-bearing top surface 52 of the disc. The projecting portion of the belt serves to confine the coins C on the rotary disc 14 as they are centrifugally thrown outwardly of the disc.

Shown at 54 and 56 in FIG. 2 are two arcuate walls immovably supported along those parts of the rotary disc periphery which lie between the entrance 40 of the coin runway 34 and the guide pulleys 44 and 46. These arcuate walls serve to prevent the coins C from falling off the peripheral parts of the rotary disc that are not fenced by the endless belt 18. At least the inner surfaces of the arcuate walls 54 and 56, for contact with the coins on the rotary disc, are of an electrically insulating material.

The coin aligning mechanism 10 further includes means for controlling the delivery of coins from the supply mechanism 12 onto the rotary disc 14, as generally identified by the reference numeral 58 in FIG. 3. The delivery control means 58 include the fixed or nonrotatable annular wall 60 arranged over that part of the endless belt 18 which encloses the periphery of the rotary disc 14, with a spacing between belt 18 and wall 60. The fixed wall 60 is formed integral with a skirt 62 of greater diameter being pendent therefrom and encircling the endless belt around the rotary disc with a clearance. At least the inside surface 64 of the fixed wall 60 is in vertical register with the inside surface 66 of the endless belt 18 around the rotary disc. Consequently, when piled in a heap of a predetermined number (three in the illustrated embodiment) or more because of an oversupply, the coins C on the rotary disc touch the fixed wall 60. Both rotary disc 14 and fixed wall 60 are entirely of an electroconductive material in this particular embodiment. Coins themselves are also conductive. Thus the contact of the piled coins with the fixed wall 60 results in its electrical connection with the rotary disc 14.

The rotary disc 14 and the fixed wall 60 are connected in circuit with a conduction sensor 68 and a battery 70. As the name implies, the conduction sensor 68 functions to sense the electrical conduction of the rotary disc and fixed wall through the piled coins.

At 72 in FIG. 3 is shown a motor control circuit for the on/off control of the drive motor 32 for the supply conveyor 24. The motor 32 is connected across a pair of supply terminals 74. Interposed between the motor and one of the supply terminals are a main on/off switch 76 and a normally closed, supply control switch 78. The main switch 76 may be activated manually for setting the drive motor 32 into and out of operation. The supply control switch 78, on the other hand, is electrically connected to the conduction sensor 68. Although the details of this conduction sensor are not specifically illustrated because of their common and well known nature, it is understood that upon establishment of electrical connection between rotary disc 14 and fixed wall 60, the conduction sensor causes the supply control switch 78 to open, thereby setting the drive motor 32 out of operation despite the closure of the main switch 76.

It may be mentioned that the coin aligning mechanism 10 further includes means, not shown, overlying the rotary disc 14 for preventing the entrance of any two stacked coins into the coin runway 34.

In operation, coins C to be processed are charged into the loading hopper 22 to be thereby deposited on the supply conveyor 24 as in FIG. 1. As this conveyor is set into motion by closing the main switch 76, FIG. 3, the coins fall off the forward extremity of the conveyor onto the rotary disc 14 of the coin aligning mechanism 10. The disc is now in rotation, in the direction of the arrow in FIG. 2 and at a speed sufficient to centrifugally send the coins toward its periphery. The rotation of the disc is frictionally transmitted to the endless belt 18 forming the rotary wall around the disc. Accordingly, centrifugally moved into abutting contact with the belt 18, the coins neither revolve about their own axes nor slip over the disc 14, there being no relative motion between disc and belt. Thus the coins are smoothly and noiselessly fed into the runway 34 in a row, to be sorted, counted, and/or otherwise processed in any desired manner.

More than a due amount of coins may be loaded at one time into the apparatus. In that case, as illustrated in FIG. 3, three or more of the coins will stack on the rotary disc 14 and so touch the inside surface 64 of the fixed wall 60 anywhere along the circumference of the disc. That results in the establishment of electrical connection between disc 14 and wall 60. Thereupon the conduction sensor 68 operates to cause the supply control switch 78 to open and hence to suspend energization of the drive motor 32. The coin supply mechanism 12 is thus set out of motion.

The coin aligning mechanism 10, however, remains in operation to continue the aligned delivery of the coins to the subsequent processing station, with a gradual decrease in the quantity of the coins on the rotary disc 14. When the electrical connection between disc 14 and wall 60 subsequently becomes broken, the conduction sensor 68 again operates to allow reclosure of the supply control switch 78 whereupon the supply mechanism 12 resumes supply of coins onto the rotary disc.

It is to be understood that the foregoing embodiment is meant purely to pictorially represent the principles of the invention and not to impose limitations thereon. A variety of modifications will readily occur to one skilled in the art. For example, while the rotary disc 14 is revolved by an unshown drive mechanism, and its revolution frictionally transmitted to the endless belt 18, in the illustrated embodiment, it is possible to directly drive the belt and to let the disc follow the belt. Further the conduction sensor 68 may not necessarily be connected directly to the rotary disc 14 via the battery 70 as in FIG. 3, but to the spindle 16 or any other part in electrically conducting relation with the disc, it being only necessary that the electrical conduction between the disc and the fixed wall 60 through the piled coins be ascertained. It will also be seen that the complete rotary disc 14 and the complete fixed wall 60 need not be electroconductive; the purpose of oversupply detection could be attained only if the coin bearing top surface of the disc and the coin contacting inner surface of the wall were both electroconductive.

All these and other departures from the illustrated embodiment are intended in the foregoing disclosure. The invention is therefore to be accorded the full scope of the claims so as to embrace any and all equivalent devices.

I claim:

1. In a coin disposing apparatus for counting, sorting and/or otherwise processing coins received from a coin supplying means, a mechanism for aligning the coins to be processed comprising:

(a) a rotary disc for receiving from a coin supplying means coins for processing, the disc being adapted to rotate at a speed sufficient to centrifugally send the coins toward the disc periphery;

(b) a coin runway extending substantially radially away from the rotary disc periphery, toward a subsequent processing station, said coin runway being in substantially coplanar relationship with the coin bearing surface of the disc, for delivering the coins from the rotary disc to the coin processing station in a row, the coin runway having an entrance adjacent the periphery of the rotary disc; and (c) a rotary wall extending along the periphery of the rotary disc, except at least where the entrance of the coin runway is located, said rotary wall being in the form of an upstanding endless belt running around the periphery of the disc with the side face of the belt in frictional contact with the side face of the periphery of the disc to cause the endless belt and the rotary disc to move together, the upper portion of the belt projecting upwardly beyond the coin bearing surface of the disc to confine the coins on the rotary disc.

2. Apparatus according to claim 1, further comprising:

(d) a fixed wall extending along and arranged over the rotary wall in vertical register therewith, the fixed wall being adapted to be contacted by coins piled up in a heap of at least a predetermined number on the rotary disc as a result of an oversupply; and (e) means for sensing the contact of the fixed wall with coins in the heap on the rotary disc to cause a coin supplying means supplying coins to the rotary disc for processing to suspend the supplying of coins.

3. Apparatus according to claim 2 wherein at least the coin bearing surface of the rotary disc and at least the coin contacting surface of the fixed wall are of an electrically conductive material, the sensing means sensing the contact of the coins with the fixed wall as a result of electrical conduction between the coin bearing surface of the rotary disc and the coin contacting surface of the fixed wall through the coins.

4. In a coin disposing apparatus for counting, sorting, and/or otherwise processing coins, a mechanism for aligning a random supply of coins to be processed, comprising:

(a) means for supplying the coins to be processed;

(b) a rotary disc for receiving the coins from the supplying means, including means for rotating the disc at a speed capable of centrifugally sending the coins toward the disc periphery, at least the coin bearing surface of the rotary disc being formed of an electrically conductive material;

(c) a coin runway extending from the rotary disc to a subsequent processing station for aligned delivery of the coins, the coin runway having an entrance adjacent the periphery of the rotary disc;

(d) a rotary wall extending along the periphery of the rotary disc, except at least where the entrance of the coin runway is located, for simultaneous rotation with the disc, the rotary wall serving to confine the coins on the rotary disc and to restrain the coins from rotation about their own axes as the coins are sent to the coin runway;

(e) a fixed wall extending along and arranged over the rotary wall in vertical register therewith, the fixed wall being adapted to be contacted by coins piled up in a heap of at least a predetermined number on the rotary disc as a result of an oversupply of coins, at least the coin contacting surface of the fixed wall being formed of an electrically conductive material; and (f) means responsive to electrical conduction between the coin bearing surface of the rotary disc and the coin contacting surface of the fixed wall, through coins heaped on the rotary disc, for sensing the contact of the fixed wall with the heap of coins on the rotary disc to cause the supplying means to suspend the supply of coins onto the rotary disc.

5. The coin processing apparatus according to claim 4, wherein the coin supplying means comprises a conveyor driven by a motor, and wherein the sensing means is adapted to set the motor of the supplying means out of rotation upon sensing the contact of the fixed wall with the coins on the rotary disc.

* * * * *